United States Patent [19]

Rose et al.

[11] Patent Number: 5,007,546

[45] Date of Patent: Apr. 16, 1991

[54] BOTTLE CAPS

[75] Inventors: Howard Rose, St. Helen's; Ian G. C. McAffer, Westerham, both of Great Britain

[73] Assignee: Waverley Pharmaceuticals Limited, Great Britain

[21] Appl. No.: 322,901

[22] Filed: Mar. 14, 1989

[30] Foreign Application Priority Data

Jul. 14, 1987 [GB] United Kingdom ..... 8716514

[51] Int. Cl.[5] ..... B65D 1/02

[52] U.S. Cl. ..... 215/32; 215/253

[58] Field of Search ..... 215/32, 251, 253, 250

[56] References Cited

U.S. PATENT DOCUMENTS

| | | | |
|---|---|---|---|
| 4,096,962 | 6/1978 | Riuli et al. | 215/32 |
| 4,526,279 | 7/1985 | Weiler et al. | 215/32 |
| 4,662,529 | 5/1987 | Moore | 215/32 |

*Primary Examiner*—Stephen Marcus
*Assistant Examiner*—Nova Stucker
*Attorney, Agent, or Firm*—Waldron & Associates

[57] ABSTRACT

A bottle cap for use with moulded plastics bottles which have an integral flanged seal over the aperture of a threaded neck, a frangible membrane joining the seal to the neck, the cap having a complementary screw-thread to that of the neck and at least two inwardly projecting resilient members located above the screw-thread such that, when the cap is screwed onto the bottle, the members pass around the seal with resilient deformation and, on unscrewing of the cap, engage the flanged seal in a lifting action, is characterized in that at least one, preferably 2, and ideally 6, of the inwardly projecting members comprises an upwardly directed blade, adapted to engage an underface of the seal so as to cut the seal, allowing its easier removal, a wall being preferably provided on the blade to reinforce the blade by acting against a side of the seal.

10 Claims, 2 Drawing Sheets

BOTTLE CAPS

This application is a Continuation of co-pending International Application PCT/GB88/00569, now abandoned.

The present invention relates to a bottle cap for use with moulded plastics bottles which have an integral flanged seal over the aperture of a threaded neck, a frangible membrane joining the seal to the neck, the cap having a complementary screw-thread to that of the neck and at least two inwardly projecting resilient members located above the screw-thread such that, when the cap is screwed onto the bottle, the members pass around the seal with resilient deformation and, on unscrewing of the cap, engage the flanged seal in a lifting action.

In particular, the present invention relates to bottle caps for use with bottles which are manufactured, filled and sealed in a single operation.

European Patent Specification No. 194068 describes a moulded plastics bottle for sterile liquids comprising:

(a) a threaded neck, the neck having a frangible annular portion above the threaded portion and also having an integral seal moulded onto the neck to close the bottle, and (b) a cap having a thread complementary with the thread of the neck, the cap containing an integral annular ring comprising at least two inwardly directed fingers which engage with the downward facing edge of the annular portion of the neck, whereby unscrewing of the cap causes upward movement of the fingers against the downward facing neck portion so that the frangible portion is broken and the seal is removed to reveal the contents of the bottle.

Reference is had to the drawings of EP 194068,and (U.S. Pat. No. 4,662,529) specifically FIG. 2, which is reproduced herewith as FIG. 6. In FIG. 6, the fingers 9 act to break off the seal 6 when the cap 7 is unscrewed. The fingers 9 have horizontal upper surfaces which abut the undersurface of seal 6 at the annular portion 4. Thus, the unscrewing of the cap gives rise to a jacking action which stretches the membrane 5 and prises off the seal 6 from the remainder of the cap.

In practice, there are problems in producing in high volume the bottles of EP 194068, primarily arising from difficulties in reproduceably moulding the bottle itself in a manner such that the frangible portion is strong enough to resist fracture during handling but weak enough to be stretched and broken by the jacking action upon unscrewing the cap.

Problems also arise with the flexibility of the fingers, especially in warm climates, when they tend to buckle and fail to remove the seal.

U.S. Pat. No. 4,526,279 seeks to tackle the above problems by providing a reinforcing wall on the finger. A flat portion of the finger engages the underside of the seal whilst an upwardly projecting wall engages the side of the seal. The edge of the seal is thus caught in a cleft of the finger, making it that much more difficult for the finger to buckle. Nevertheless, problems can still occur if the edge of the seal deforms, allowing the finger to slip over and off.

The present invention is characterised in that at least one, preferably at least two, and ideally 6, of the inwardly projecting members comprises an upwardly directed blade adapted to engage an underface of the seal. In a preferred embodiment, the blade member(s) further comprise a reinforcing wall adapted to engage a side of the seal.

Unscrewing of the cap causes upward movement of the blade(s) to cut in to the underface, preferably the frangible membrane, while prising the seal from the bottle, giving a more efficient severance of the seal. The reinforcing wall functions by acting against a side of the seal when upward pressure is applied, preventing buckling of the blade support.

In a preferred embodiment, the blade members are arranged in an interrupted annular ring, a total of 6 members being considered ideal from the point of view of strength and overall efficiency. However, any number may be employed, according to requirements. For maximum efficacy, the blade members are equally spaced apart in the ring.

In an alternative embodiment, the blade members are intersperced with non-cutting, cleft members, such as are described in U.S. Pat. No. 4,526,279. A total of three or four of each of the two types of member is preferred, although it is possible to provide just one blade and, for example, 3 cleft members. Other configurations will be apparent to those skilled in the art.

In order to retain the seal within the cap, the interrupted annular barrier ring formed by the blade members may also be supplemented by baffles between the blades. Alternatively, the baffles may be provided above or below the ring, provided that their purpose is served, and cutting is not hindered.

The blade, cleft and baffle members may be fused, or formed, directly into the cap, or they may be connected via one or more support arms. While the latter method tends to be weaker, it is preferable in some circumstances.

The blades may be in any form suitable for achieving the purpose of the invention. Whilst a square edge may be suitable for some applications, it is generally preferred that the blades be in the form of curved edges, to avoid catching in the cut surface.

In particular, it is advantageous to present a cutting point to the seal underface to puncture the seal. Once punctured, the seal becomes easier to sever, and may be cut by a wedging action using a blunt edge.

The cap may also be provided with a tamper-proof ring below the thread, designed to engage a complementarily-shaped part on the container. Such tamper-proof rings are known in the art. For example, the tamper-proof ring can comprise a series of internal teeth or ratchets which engage with complementary teeth or ratchets on the bottle neck, making it impossible to remove the cap from the bottle until the tamper-proof ring has itself been removed, for example by rupture of the ring. To this end the ring can comprise a pull-tab and a line of weakness, such that grasping and pulling of the pull-tab leads to break away at the line of weakness of the ring from the rest of the cap.

The caps of the present invention may be made from any suitable material, but preferably from plastics, especially thermoplastics. They may be made integrally or piecemeal. If the latter, then it is usual for the top of the cap to be snap-fitted, glued or heat-welded into place, and the blade members may be provided on an annular member adapted to seat above the screw-thread.

The latter can be particularly advantageous in that the blades may be formed from metal. There is then less chance of their buckling. The necessary resilience may be a quality of the metal itself, or the blade(s) may be seated in a plastics annulus, for example. The annulus may be inserted in the cap and seated in a convenient groove or upon a suitable shoulder or abutments.

The caps of the invention may be provided separately, together with a suitable bottle, in packs, or in other suitable methods of packaging. Although it is preferred that the bottles to be used are hermetically sealed, any bottle having a suitable upwardly removable portion on a screw-threaded member may be employed in conjuction with the caps of the present invention.

The present invention will now be described by way of example with reference to FIGS. 1 to 5 of the accompanying drawings, in which.

Figure 1:
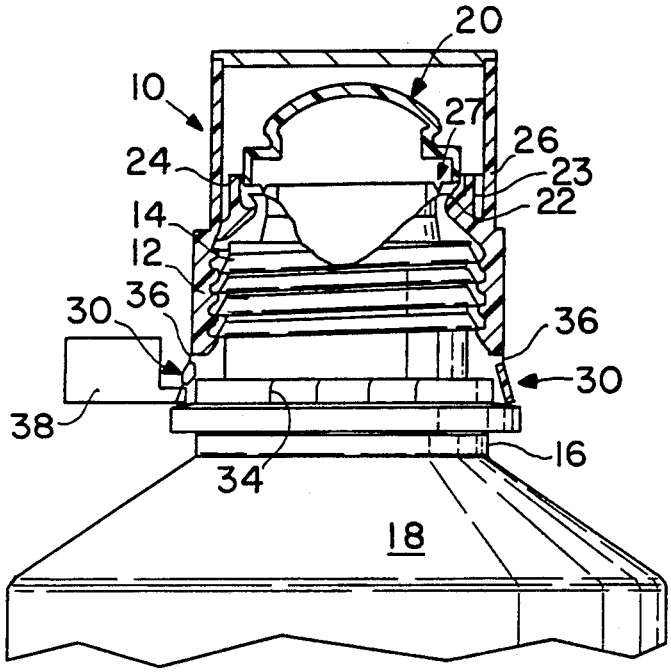
FIG. 1 is a vertical cross-section of a cap of this invention when threaded on the neck of a bottle.
Figure 2:
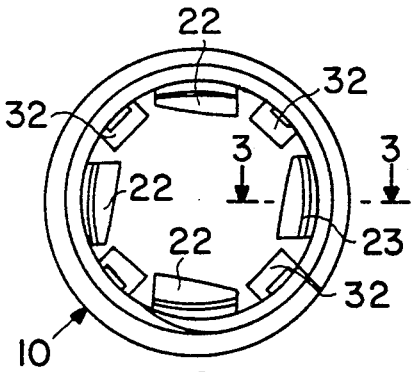
FIG. 2 is a view from beneath of an alternative cap of the invention.
Figure 3:
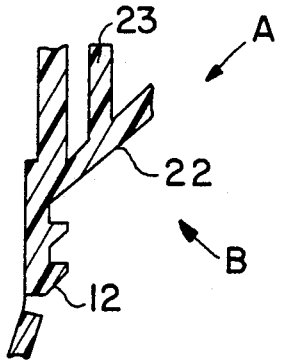
FIG. 3 is a vertical section on the line 3-3 of FIG. 2 through part of the cap of FIG. 1.
Figure 4:
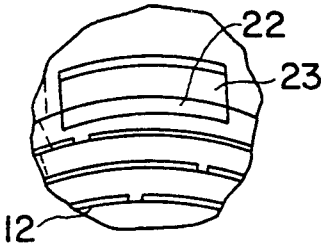
FIG. 4 is a view on arrow "A" of FIG. 3.
Figure 5:
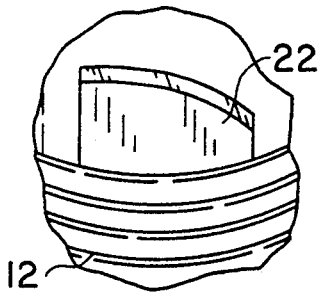
FIG. 5 is a view on arrow "B" of FIG. 3.
Figure 6:
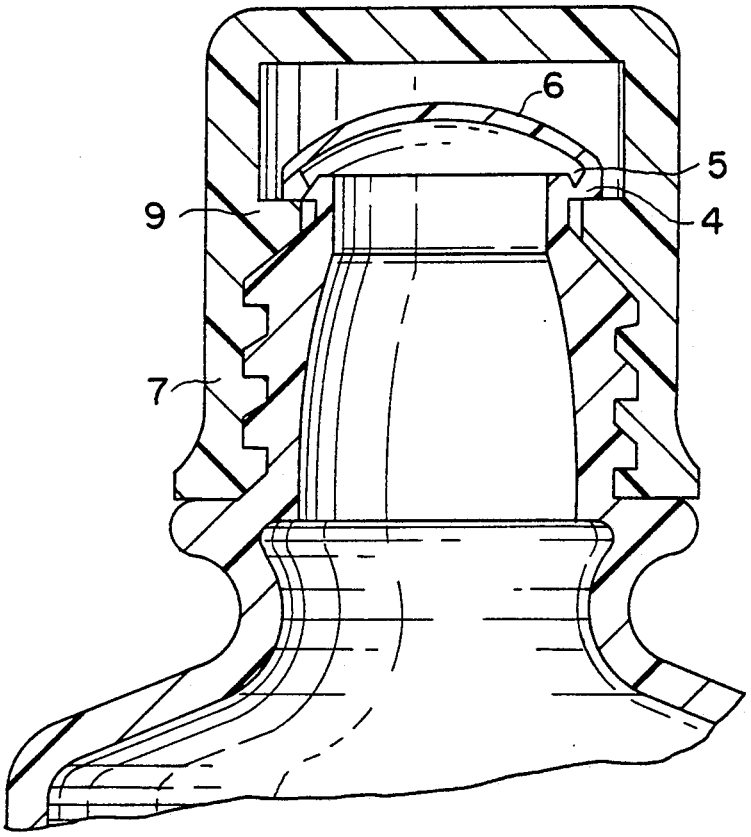
FIG. 6 (PRIOR ART)

FIG. 6 is a sectional view of a prior art bottle cap, the drawing being a reproduction of FIG. 2 from European Patent No. 194068 (U.S. Pat. No. 4,662,529).

The moulded plastics cap 10 of this invention has a thread 12 complementary to the thread 14 of the neck 16 of a bottle 18. The bottle 18 has an integral seal 20 formed during the moulding and filling of the bottle. Four internal, inwardly- and upwardly-directed blades 22 are shown in FIG. 2 for simplicity, although 6 are preferred, and are provided on the cap 10 and engage with an underface 24 of an annular portion 26 of the neck 16 of the bottle 18. The blades 22 are sufficiently flexible to slide over the seal 20 when the cap is screwed on to the thread 14 of the bottle 18. Wall 23 engages the side of the annular portion of the seal 26 to strengthen the blade 22 and to help to provide leverage.

The cap 10 is provided with a tamper-proof ring 30 below the thread 12 with a series of internal ratchets (not shown, being of conventional design) which engage with complementary ratchets 34 on the bottle neck 16, making it impossible to remove the cap from the bottle until the tamper-proof ring has itself been removed. The ring 30 is joined to the rest of the cap 10 by a line of weakness 36, and has a pull-tab 38.

Grasping and pulling of the pull-tab 38 leads to break away of the tamper-proof ring 30 at the line of weakness 36, allowing unscrewing of the cap 10.

Unscrewing of the cap 10 causes upward movement of the blades 22 to cut in to the underface while lifting the seal 20 from the bottle, giving an efficient severance of the seal at frangible membrane 27. Bending of the blades is prevented by the presence of walls 23. In order that the seal 20 is securely retained within the cap 10, the blades may be supplemented by barrier elements such as baffles 32 to form an interrupted annular barrier ring 28.

We claim:

1. A bottle cap for use with moulded plastics bottles which have an integral flanged seal over the aperture of the threaded neck, a frangible membrane joining the seal to the neck, the cap having a complementary screw-thread to that of the neck and at least two inwardly projecting resilient members located above the screw-thread such that, when the cap is screwed onto the bottle, the members pass around the seal with resilient deformation and, on unscrewing the cap, engage the flanged seal in a lifting action, characterized in that at least one of the inwardly projecting members comprises an upwardly directed blade, adapted to engage an undersurface of the flanged seal, such that upon unscrewing of the cap, said upwardly directed blade will cut into the undersurface while lifting the flanged seal to provide an efficient severance of the seal from the bottle neck.

2. A cap according to claim 1 comprising as least two blade members.

3. A cap according to either of claims 1 and 2 wherein the blade members further comprise a reinforcing wall, adapted to engage a side of the seal.

4. A cap according to claim 1 wherein the blade members form an interrupted, annular ring within the cap.

5. A cap according to claim 4 wherein the blade members are substantially equally spaced around said cap.

6. A cap according to either of claims 4 and 5 wherein at least one barrier element is interposed between two of said blade members for the purpose of retaining the seal within the cap.

7. A cap according to claim 4 having 6 blade members.

8. A cap according to claim 7 having no barrier elements.

9. A cap according to claim 1 wherein at least the cutting edge of the blade is metal.

10. A bottle as described in claim 1 having a cap as described in claim 1.

* * * * *